US009439481B1

(12) United States Patent
Pfaff

(10) Patent No.: US 9,439,481 B1
(45) **Date of Patent: *Sep. 13, 2016**

(54) JEWELRY AND METHOD OF WEARING

(71) Applicant: Laura Pfaff, Milwaukee, WI (US)

(72) Inventor: Laura Pfaff, Milwaukee, WI (US)

( * ) Notice: Subject to any disclaimer, the term of this patent is extended or adjusted under 35 U.S.C. 154(b) by 83 days.

This patent is subject to a terminal disclaimer.

(21) Appl. No.: 14/231,144

(22) Filed: Mar. 31, 2014

Related U.S. Application Data

(63) Continuation-in-part of application No. 13/471,240, filed on May 14, 2012, now Pat. No. 8,752,402.

(60) Provisional application No. 61/489,904, filed on May 25, 2011.

(51) Int. Cl.

| | |
|---|---|
| ***A44C 7/00*** | (2006.01) |
| ***A45D 8/12*** | (2006.01) |
| ***A44C 27/00*** | (2006.01) |
| ***A44C 15/00*** | (2006.01) |

(52) U.S. Cl.
CPC ..... *A44C 7/005* (2013.01); *A44C 15/00* (2013.01); *A44C 27/00* (2013.01)

(58) Field of Classification Search
None
See application file for complete search history.

(56) References Cited

U.S. PATENT DOCUMENTS

| | | | | |
|---|---|---|---|---|
| 2,033,943 | A | 3/1936 | Lely | |
| 2,629,989 | A | 3/1953 | McDonald | |
| 4,286,358 | A | 9/1981 | Levin | |
| 4,733,544 | A | 3/1988 | Londaro | |
| 6,758,221 | B1 * | 7/2004 | Stachowski | A45D 8/02 132/273 |
| 2005/0199003 | A1 | 9/2005 | Haraldsted et al. | |

OTHER PUBLICATIONS

Crystal Rhinestone Hair Screw Set of 5, retrieved May 2, 2011, www.annlesliedesigns.com/hd-4188-2c.html, 1 page.

Final Office Action on U.S. Appl. No. 13/471,240, mail date Feb. 5, 2014, 8 pages.

Hair Screw Products from Alibaba.com, retrieved May 2, 2011, www.alibaba.com/product-gs/336331406/hair_screw.html, 2 pages.

Non-Final Office Action on U.S. Appl. No. 13/471,240,mail date Oct. 1, 2013, 8 pages.

Notice of Allowance on U.S. Appl. No. 13/471,240, mail date Feb. 19, 2014, 5 pages.

* cited by examiner

*Primary Examiner* — Jack W Lavinder
(74) *Attorney, Agent, or Firm* — Foley & Lardner LLP

(57) ABSTRACT

A jewelry item includes a first ornament, a conical helical coil, and a pad. The conical helical coil includes a plurality of turns, the first ornament being attached to a first turn of the plurality of turns. The pad includes a central bore configured for receiving the helical coil. The jewelry item further includes a second ornament engaging a second turn of the plurality of turns. A compressive force between adjacent turns of the helical coil couples the jewelry item to a body part.

20 Claims, 3 Drawing Sheets

JEWELRY AND METHOD OF WEARING

CROSS-REFERENCE TO RELATED APPLICATIONS

The present application claims priority to and is a continuation-in-part of U.S. application Ser. No. 13/471,240, filed on May 14, 2012, now U.S. Pat. No. 8,752,402, which claims the benefit of and priority to U.S. Provisional Application No. 61/489,904, filed on May 25, 2011, including the specification, drawings, claims and abstract, which are both incorporated herein by reference in their entireties.

BACKGROUND

The present disclosure relates generally to the field of jewelry. More specifically, the disclosure relates to jewelry that can be attached to a body without piercing.

Jewelry including earrings have been worn for hundreds of years. Generally, earrings are attached to the ear by a post that extends through a piercing in the earlobe or other part of the ear. Other parts of the bodies may also be pierced to use similar jewelry. There are several disadvantages to piercings. The piercing process may be painful and results in a permanent holes in a person's ear. Further, piercings can become infected.

Jewelry can also be designed to attach to an ear or other body part by other means not requiring a pierced opening. Such clip-on jewelry generally relies on a clamp or other mechanism such as one or more magnets to secure the jewelry to the body. Magnets and clamps can be uncomfortable to wear or can be susceptible to disengaging from the ear.

Thus, there is a need for a comfortable means of wearing jewelry. Further, there is a need for a stable coupling for jewelry that does not require piercing, clamps or magnets. Further still, there is a need for a coupling for an earring that does not uncomfortably pinch the earlobe.

SUMMARY

One embodiment of the disclosure relates to a jewelry item, including a first ornament, a conical helical coil, and a pad. The conical helical coil includes a plurality of turns, the first ornament being attached to a first turn of the plurality of turns. The pad includes a central bore configured for receiving the helical coil. The jewelry item further includes a second ornament engaging a second turn of the plurality of turns. A compressive force between adjacent turns of the helical coil couples the jewelry item to a body part.

Another embodiment relates to an earring, including a first ornament, a coil comprising wire having a plurality of turns, and a second ornament. The first ornament is coupled to and fixed to the wire. The second ornament is disposed around the wire in a non-fixed fashion. A compressive force between adjacent turns of the coil couples the earring to an ear.

Yet another embodiment relates to a method of manufacturing an earring. The method includes attaching a first ornamental piece to a coil and sliding a second ornamental piece onto the coil. A first member of the second ornamental piece is moveable along the coil. The method further includes providing a member around a segment of the coil. The member is a different material than the coil, the member having a greater coefficient of sliding friction than material of the coil.

According to another embodiment, an earring including a coil can be provided in a package including instructions. The instructions can describe the engagement of an earlobe to the coil.

It is to be understood that both the foregoing general description and the following detailed description are illustrative and explanatory only, and are not restrictive of the invention as claimed.

BRIEF DESCRIPTION OF THE DRAWINGS

These and other features, aspects, and advantages of the present invention will become apparent from the following description, appended claims, and the accompanying illustrative embodiments shown in the drawings, which are briefly described below.

DETAILED DESCRIPTION OF THE PREFERRED EMBODIMENTS

Figure 1:
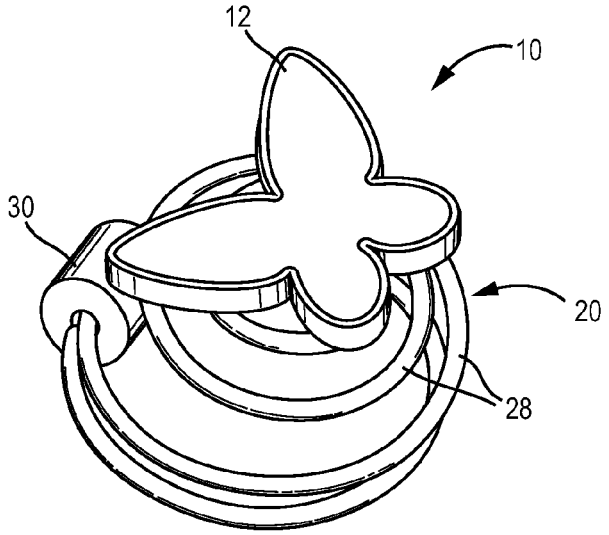
FIG. 1 is a perspective view of an earring, according to an exemplary embodiment.
Figure 2:
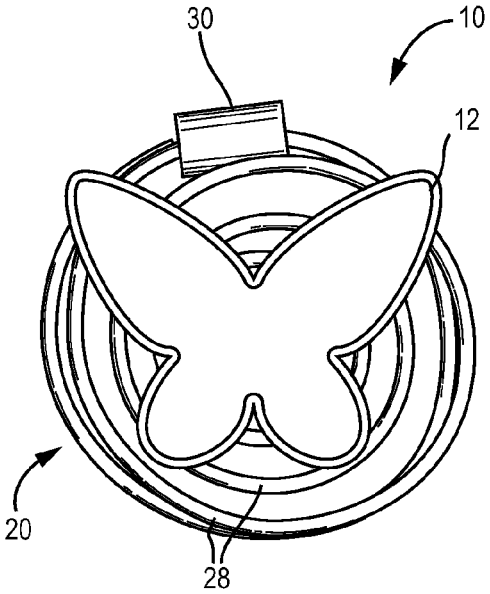
FIG. 2 is a top view of the earring of FIG. 1.
Figure 3:
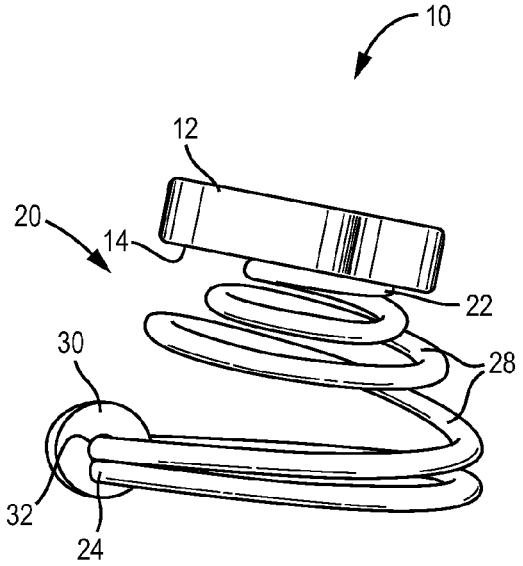
FIG. 3 is a side view of the earring of FIG. 1.

Referring to FIGS. 1-3, jewelry item, such as, an earring 10 is shown according to an exemplary embodiment. Earring 10 is configured to be coupled to a portion of the ear, such as the earlobe 40 (see FIGS. 4-5) without the use of a pierced hole in the ear. While earring 10 will be described as a piece of jewelry for the ear, a similar jewelry item may be configured to adorn another part of the body, such as the lip, or the nose. Earring 10 includes an ornament 12 (e.g., decorative element, etc.), a coil 20, and a pad 30 (e.g., plug, insert, etc.).

Ornament 12 includes one or more decorative elements that are displayed when earring 10 is coupled to a body part. Ornament 12 may be a single body, as shown in the FIGURES, or may include multiple elements (e.g., interlocking loops, chains, strands, etc.). Ornament 12 can be any shape or size and is not shown in a limiting fashion. Ornament 12 can include gemstones, figures, or any ornamental feature. Ornamental features can also be provided on coil 20.

Referring to FIG. 3, coil 20 extends from a first end 22 coupled to the rear side 14 of ornament 12 to a distal second end 24. First end 22 of coil 20 may be coupled to ornament 12 with any appropriate coupling method such as with adhesive, with a mechanical fastener, by welding, or by soldering. Coil 20 serves as a coupling element for earring 10.

Coil 20 is preferably a helical coil that is formed by curling an elongated element in a series of turns 28. According to an exemplary embodiment, coil 20 is formed from a metal wire. In other exemplary embodiment, coil 20 may be formed of a polymer (e.g., plastic, rubber and similar materials) or other material with a suitable elasticity. Coil 20 preferably is malleable. While the elongated element forming coil 20 is shown in the FIGURES as having a circular cross-section, coil 20 may be formed from an elongated element having an otherwise shaped cross-section (e.g., square, rectangular, hexagonal, elliptical, oval, etc.) in other exemplary embodiments.

In one embodiment, coil 20 has an elasticity that allows earring 10 to be attached to earlobe 40 without significant discomfort or painful pinching and yet secures earring 10 to earlobe 40 during normal use. Preferably, a compressive force imparted between adjacent rings or turns 28 of coil 20 hold earring into earlobe 40.

In a preferred embodiment, coil 20 can have the material and elasticity of coils associated with the coils of hair screw jewelry or twist-in-hair jewelry. In one embodiment, coil 20 can be a copper base metal that is coated for comfort. In another embodiment, coil 20 can be a steel base metal that is coated (e.g., coated with a tin material). Coil 20 can also be or include gold, silver, aluminum, nylon, plastic, brass, nickel, or any suitable material for engaging earlobe 40.

The element that makes up coil 20 can be round in cross section and be less than 1/16 of an inch in diameter (e.g., 1/24, 1/32, 3/64, 3/128, etc. of an inch) in one embodiment. In other embodiments, the element can be more than 1/8 of an inch in diameter or less than 1/24 an inch in diameter. The dimensions provided above are exemplary only and not disclosed in a limiting fashion.

Coil 20 can have a first ring or turn 28 approximately 0.5 inches in diameter with successive rings or turns 28 smaller in diameter according to one embodiment. First turn 28 can have a sphere or other stop at its end 24 according to one embodiment. A distance from the first turn 28 and the last turn 28 (i.e., end 22-turn 28 attached to ornament 12) can be approximately 3/8 inches in a longitudinal direction through the center points of the turns 28 of coil 20 in one embodiment. Coil 20 can have turns 28 with a variety of sizes depending materials, sizes of earlobe 40, desired elasticity, etc. Larger and smaller dimensions for coil 20, turns 28 and the element associated with coil 20 are possible. The dimensions provided above are exemplary only and not disclosed in a limiting fashion.

Pad 30 is a generally cylindrical member with a central bore 32 that is sized to receive the elongated member forming coil 20. Pad 30 is coupled to coil 20 by feeding second end 24 into bore 32 and moving pad 30 along the length of coil 20. Pad 30 may be formed from a resilient material, such as an elastomer (e.g., polymer, plastic, rubber, etc.), or may be formed from a rigid material, such as a metal, glass, paper, or a ceramic. Pad 30 can also be a foam material. Pad 30 can be latex free according to one embodiment. Pad 30 can be clear or colored.

Pad 30 can be formed by dipping coil 20 or otherwise coated on coil 20. Pad 30 is configured to be able to move along the length of coil 20. Bore 32 may therefore have a diameter greater than the diameter of the elongated member forming coil 20 to compensate for the diameter of turns 28 and/or pad 30 may flex to compensate for the diameter of turns 28. According to an exemplary embodiment, bore 32 may be centrally located along the longitudinal axis of pad 30. In other exemplary embodiments, bore 32 may be offset from the longitudinal axis of pad 30. In other exemplary embodiments, pad 30 may have a slit or cut from the outside surface to bore 32 to allow pad to be slid or clipped onto coil 20 anywhere along the length of coil 20 instead of being fed onto coil 20 at second end 24.

Pad 30 preferably has a greater diameter than the element associated with coil 20 (e.g., 3/16-3/8 of an inch). Pad 20 can have a wall thickness of approximately 1/16 of an inch in one embodiment. The member for coil 20 can be provided with pad 30 attached by the manufacturer.

In a preferred embodiment, pad 30 has a coefficient of sliding friction with respect to skin that is relatively high so that earring 10 is less likely to slide from earlobe 40. Preferably, pad 30 has a higher coefficient of sliding friction with respect to skin that is greater than the material of coil 20.

Pad 30 can be short (e.g., 1/8 of an inch in length) or cover 90 percent of the circumference of the first turn 28 associated with coil 20. In other alternatives, pad 30 can cover more than one turn 28 of coil 20. In one alternative embodiment, pad 30 covers two adjacent turns 28 of coil 20 and earlobe 40 is placed between the two padded rings 28.

In one embodiment, two pads 30 are provided; one on each of two adjacent rings of coil 20. Alternatively, pad 20 can be a non-cylindrical clip having a C-shaped cross-section for engaging coil 20. Pad 20 can also have a square shaped or rectangular shaped cross sectional area. The dimensions provided for pad 20 are exemplary. Other dimensions for pad 20 are possible without departing from the scope of the invention.

Figure 4:
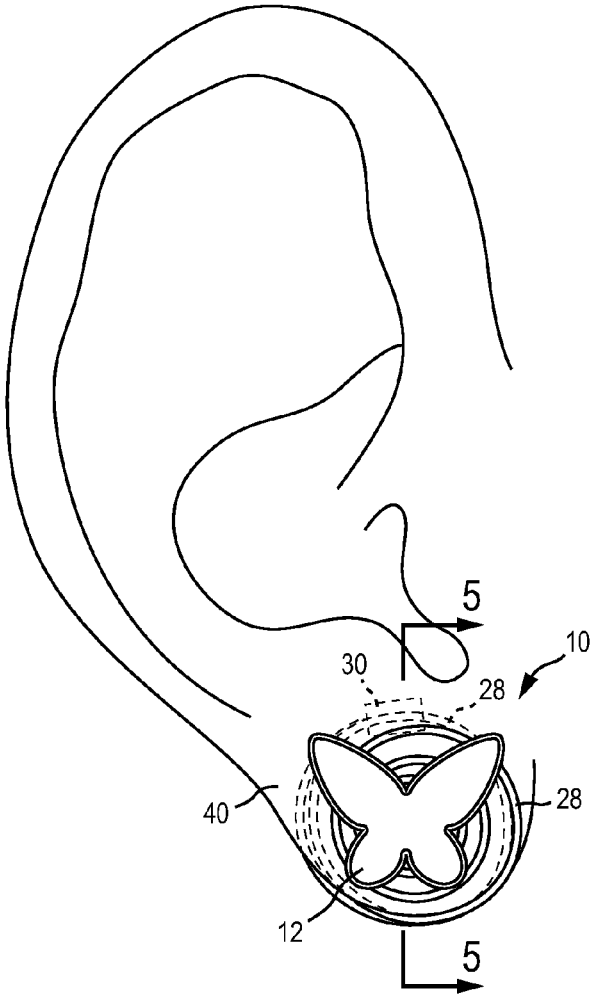
FIG. 4 is a perspective view of the earring of FIG. 1 coupled to an ear lobe, according to an exemplary embodiment.
Figure 5:
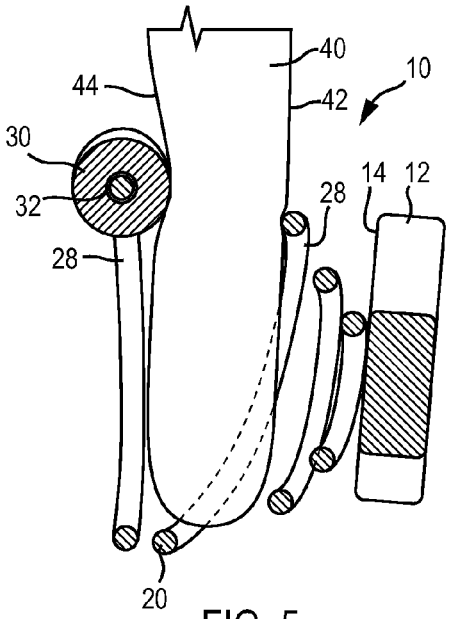
FIG. 5 is a cross-section of the earring and ear lobe of FIG. 4, taken along line 5-5.

Referring to FIGS. 4-5, earring 10 may be coupled to an earlobe 40 by inserting earlobe 40 between adjacent turns 28 of coil 20. In one embodiment, coil 20 forms a tension or extension spring. According to an exemplary embodiment, earring 10 may be coupled to an earlobe by first orienting earring 10 such that pad 30 is positioned at the upper portion of a turn 28 (e.g., the 12 o'clock position) and at least one half of a turn from end 24. Earlobe 40 may then be stretched downward and earring 10 may be moved upward to engage earlobe 40. As earlobe 40 is inserted between turns 28 of coil 20, turns 28 are pushed away from their rest positions, resulting in a compressive force applied to the first side 42 and the second side 44 of earlobe 40 and thereby coupling earring 10 to earlobe 40.

According to an exemplary embodiment, the diameter of the turns 28 and the distance between adjacent turns 28 increases as the distance from the ornament 12 increases (with the exception of the last turn 28 which includes at least a portion that is directly adjacent to the remaining turn 28 in one embodiment). The variable diameter of turns 28 of coil 20 provides a variable tensile force between adjacent turns 28. In this way, the force applied to earlobe 40 may be adjusted by inserting earlobe 40 into coil 20 closer to ornament 12.

Advantageously, coil 20 allows earring 10 to be attached according to a twist-on motion. This allows gradual tension to be exerted against earlobe 40 so that the wearer can appropriately attach earring 10 to earlobe 40 without uncomfortable squeezing or pinching. The twist-on motion involves turning earring 10 to engage ear lobe 40. A 1/4 (quarter) to 1/2 (half) turn is generally satisfactory, although other size turns are possible. Generally, the greater the turn, the tighter the attachment to earlobe 40 depending on material types, coil sizes, earlobe size, etc.

Pad 30 contacts earlobe 40 when earlobe 40 is inserted between adjacent turns 28 of coil 20. Pad 30 may be positioned along coil 20 to contact first side 42 or second side 44 of earlobe 40. Pad 30 provides a localized area of increased pressure to facilitate the coupling of earring 10 to earlobe 40. In other exemplary embodiments, pad 30 may not be utilized. In still other exemplary embodiments, more than one pad 30 may be utilized (e.g., a pad 30 may be provided on either side of earlobe for both first side 42 and second side 44, etc.).

It should be understood that variations of earring 10 may be configured to provide different aesthetic effects, to be coupled to other body parts, or to be more effectively coupled to other parts of the ear (e.g., the tragus, the helix, etc.). For instance, coil 20 may be configured with a larger or smaller space between adjacent turns 28 to better accommodate thicker or thinner body parts. The space between adjacent turns 28 used to engage earlobe 40 can vary from 0 to ⅛ of an inch in one embodiment. In other embodiments, the space can be from 0 to ⅜ of an inch or from 0 to ½ of an inch depending on body part sizes.

In other embodiments, the diameter of the turns 28 may decrease as the distance from the ornament 12 increases so that larger, more prominent turns 28 are visible on the side of the body part with ornament 12. In other embodiments, turns 28 may not be circular and may be otherwise contoured or shaped (e.g., square-shaped, egg-shaped, elliptical, oval, etc.).

In one embodiment, earring 10 can be embodied as a twist-in-hair jewelry or hair screw jewelry and packaged as an earring. The hair screw jewelry can include directions for attaching the jewelry to earlobe 40 in accordance with this disclosure. The directions can state: place coil 20 next to ear lobe 40 and engage earlobe 40 between adjacent ring turns 28 of coil 20. The directions can also note that ear lobe 40 can be engaged with a twist motion until a suitable, yet comfortable compressive force is applied to earlobe 40. Alternatively, a more linear motion can be used to engage earlobe 40. The directions for engagement can also include widening the distance between adjacent rings or turns 28 if necessary by gently pulling on rings or turns 28 and narrowing the distance between adjacent turns or rings 28 if necessary by gently squeezing turns or rings 28 together.

Figure 6:
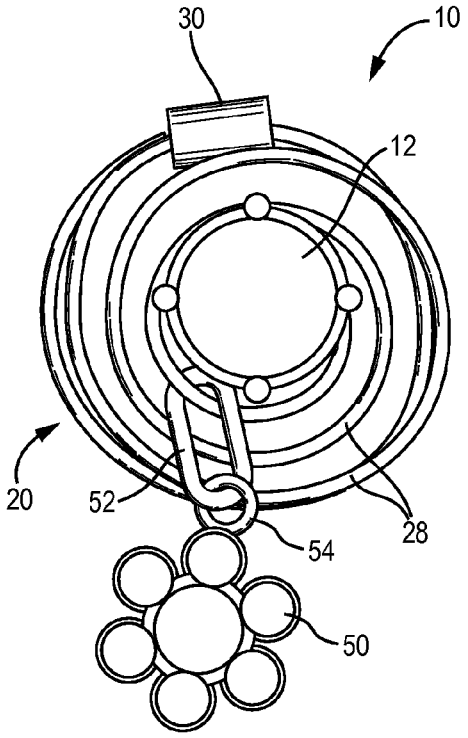
FIG. 6 is a perspective view of an earring, according to an exemplary embodiment.

Referring to FIG. 6, earring 10 may further include a second ornament 50 that is coupled to coil 20 with a link 52. Second ornament 50 is configured to be removable from coil 20, allowing a user to mix earring 10 with different second ornaments 50. Second ornament 50 includes one or more decorative elements that are displayed when earring 10 is coupled to a body part. Second ornament 50 may be a single body, as shown in FIG. 6, or may include multiple elements (e.g., interlocking loops, chains, strands, etc.). Second ornament 50 can be any shape or size and is not shown in a limiting fashion. Second ornament 50 can include gemstones, figures, or any ornamental feature. In one embodiment, a number of ornaments similar to ornament 50 can be attached to coil 20. The ornaments can dangle from coil 20 in one embodiment. In some embodiments, multiple ornaments 50 may be coupled to coil 20.

Link 52 interlocks coil 20 and a coupling feature of second ornament 50, shown as a loop 54 in one embodiment. In other embodiments, link 52 may be rigidly coupled to second ornament 50 (e.g., welded to a portion of second ornament 50, integrally formed with second ornament 50, etc.). In one embodiment, link 52 hangs from a turn 28 of coil 20, allowing second ornament 50 to dangle from coil 20 beneath ornament 12. In another embodiment, earring 10 may not include link 52. Instead, second ornament 50 may be coupled directly to coil 20 by passing a turn 28 of coil 20 through an opening, such as loop 54 or another appropriately sized aperture.

Figure 7:
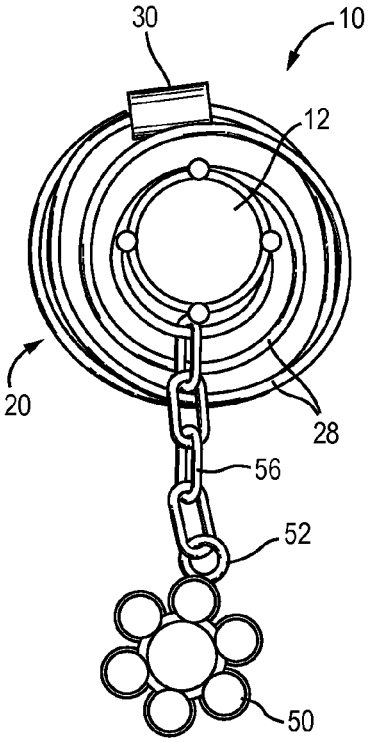
FIG. 7 is a perspective view of an earring, according to an exemplary embodiment.

Referring to FIG. 7, in another embodiment, second ornament 50 may be coupled to coil 20 with multiple links forming a chain 56, with a link on one end of chain 56 interlocking second ornament 50 and a link on the opposite end interlocking coil 20. The chain may include a single strand or may include multiple strands.

Figure 8:
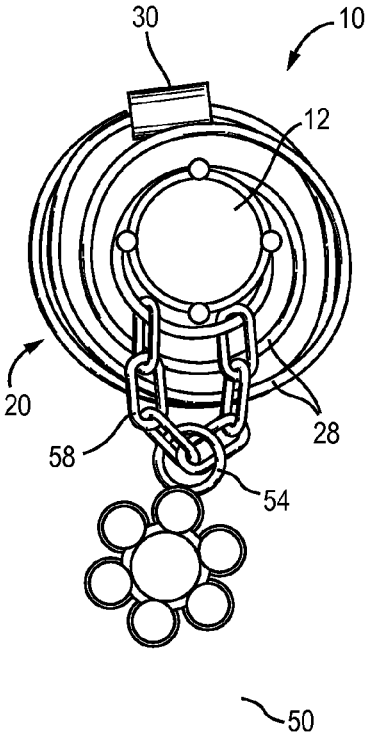
FIG. 8 is a perspective view of an earring, according to an exemplary embodiment.

Referring to FIG. 8, in another embodiment, second ornament 50 may be coupled to coil 20 with a chain 58 that passes through loop 54. A link on one end of chain 58 interlocking coil 20 and a link on the opposite end of chain 58 also interlocking coil 20.

Second ornament 50 is coupled to coil 20 by first removing pad 30 from second end 24 of coil 20 in one embodiment. Second end 24 is fed into link 52 and link 52 is moved along the length of coil 20 to a desired location. Pad 30 is then coupled to coil 20 by feeding second end 24 into bore 32 and moving pad 30 along the length of coil 20. Link 52 is slideably engaged along the length of turn 28 of coil 30 in one embodiment. The outer diameter of pad 30 is larger than the inner diameter of link 52. The placement of pad 30 between link 52 and second end 24 retains link 52 on coil 20 in one embodiment.

In one embodiment, pad 30 may be advanced along coil 20 to abut link 52 and to limit the movement of link 52 along coil 20. In another embodiment, a second pad 30 may be provided on coil 20 on the opposite side of link 52, such that movement of link 52 along coil 20 is further limited. In another embodiment, other retaining features, such as O-rings may be provided along coil 20 to limit the movement of link 52. In other embodiments, link 52 may engage coil 20 in such a way that it is not moved along coil 20 by incidental forces or by gravity, but may be moved along coil 20 by a user applying a force to the link 52. For example, at least a portion of link 52 may be formed from a resilient material having an opening for receiving coil 20 such that the material applies a compressive force to coil 20. Link 52 may be formed entirely of the resilient material or may include a rigid portion (e.g., a metal portion) that is configured to receive a resilient insert, such as an O-ring. In another embodiment, coil 20 can include one or bent portions for receiving link 52 so that link 52 rests in the bent portion when slid to the position of the bent portion.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is important to note that the construction and arrangement of the earring as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages presented in the present application. Accordingly, all such modifications are intended to be included within the scope of the present disclosure. Other substitutions, modifications, changes and omissions may be made in the design, operating conditions and arrangement of the various exemplary embodiments without departing from the scope of the present disclosure.

What is claimed is:

1. An earring jewelry item, comprising:

a first ornament;

a conical helical coil, the conical helical coil comprising a wire having a plurality of turns between a first end and a second end, the first ornament being attached to a first turn at the first end of the plurality of turns, the first end being at a top of the conical helical coil and the first ornament at least partially hiding the first turn, wherein the conical helical coil has a larger diameter turn of the turns at a bottom of the conical helical coil for more easily attaching the jewelry item to a body part between two of the turns at the bottom, the bottom terminating at the second end;

a pad comprising a central bore configured for receiving the conical helical coil and positioned at a second turn of the turns;

a second ornament engaging a third turn of the plurality of turns; and wherein a compressive force between the two of the turns of the helical coil at the bottom couples the jewelry item to a body part.

2. The jewelry item of claim 1, wherein the second ornament includes a circular member having an aperture, the aperture receiving the coil.

3. The jewelry item of claim 1, wherein the helical coil is formed of one of a metal wire or a polymer.

4. The jewelry item of claim 1, wherein the second ornament includes a circular member having an aperture, the aperture receiving the coil, wherein the pad may be positioned along the length of the helical coil and prevents the second ornament from sliding past a first position on the coil.

5. The jewelry item of claim 4, wherein the pad is positioned on one of the turns of the coil proximate to the body part when worn by a user.

6. The jewelry item of claim 1, wherein the jewelry item is configured to be coupled to an ear.

7. An earring, comprising:

a first ornament;

a coil comprising wire having a plurality of turns between a first end and a second end, the first ornament being coupled to and fixed to the wire at the first end, wherein a first turn of the turns has a first diameter less than a second diameter of a second turn of the turns, the first turn being adjacent the second turn on a first side of the second turn wherein the second diameter is less than a third diameter, where in a third turn has the third diameter and is adjacent the second turn on a second side of the second turn, the second side being opposite the first side, wherein the first ornament is closer to the first turn than the third turn, wherein the first ornament covers the first end, whereby a compressive force at a location between at least two of the first turn, the second turn, and the third turn of the coil couples the earring to an ear; and a second ornament disposed around the wire in a non-fixed fashion.

8. The earring of claim 7, wherein the coil forms a conical helix.

9. The earring of claim 7, wherein the wire is a metal or a polymer.

10. The earring of claim 7, further comprising a pad, the pad being positioned along the length of the wire at a position, wherein the second ornament is disposed between the pad and the first ornament.

11. The earring of claim 10, wherein the second ornament dangles from the wire.

12. A method of manufacturing an earring, comprising:

attaching a first ornamental piece to a coil, wherein the coil is configured as a conical helix, wherein the conical helix comprises a wire having a plurality of turns between a first end of the wire and a second end of the wire, wherein a first turn of the turns has a first diameter less than a second diameter, wherein a second turn of the turns has the second diameter, wherein the first turn is attached to the first ornamental piece and wherein the second turn is configured to attach to an ear lobe by rotating the conical helix onto the ear lobe to provide a compressive force between the second turn and a neighboring turn, wherein the first ornamental piece overlaps the first end of the wire;

sliding a second ornamental piece onto the coil, wherein a first member of the second ornamental piece is moveable along the coil; and providing a second member around a segment of the coil, the second member being a different material than the coil, the second member having a greater coefficient of sliding friction than material of the coil with respect to the material of the coil.

13. The method of claim 12, wherein the coil forms a conical helix.

14. The method of claim 13, wherein the coil is formed of one of a metal wire or a polymer.

15. The method of claim 12 further comprising the second member is a pad, the pad comprising a central bore configured for receiving the coil.

16. The method of claim 15 wherein the pad may be positioned along the length of the coil.

17. The method of claim 16, wherein the pad prevents the second ornamental piece from being removed from the coil.

18. The method of claim 15, wherein the second ornamental piece comprises a first piece for slideably engaging the coil and an ornamental piece attached to the first ornamental piece.

19. The method of claim 15, wherein the coil is wider at a bottom than a top, wherein the first ornamental piece is fixedly attached to the top.

20. The method of claim 15, wherein the coil has a spacing between adjacent rings, the adjacent rings being configured to receive an ear lobe in spacing and elasticity, the elasticity being chosen so that the earring is maintained on the ear lobe during normal use without uncomfortable pinching.

* * * * *